US006091430A

United States Patent [19]

Bodin et al.

[11] Patent Number: 6,091,430

[45] Date of Patent: Jul. 18, 2000

[54] SIMULTANEOUS HIGH RESOLUTION DISPLAY WITHIN MULTIPLE VIRTUAL DOS APPLICATIONS IN A DATA PROCESSING SYSTEM

[75] Inventors: William Kress Bodin, Boca Raton, Fla.; Dale Robert Whitfield, London, United Kingdom

[73] Assignee: International Business Machines Corporation, Armonk, N.Y.

[21] Appl. No.: 08/040,698

[22] Filed: Mar. 31, 1993

[51] Int. Cl.[7] ..... G09G 5/00

[52] U.S. Cl. ..... 345/510; 345/132

[58] Field of Search ..... 345/132, 133, 345/119, 120, 115, 116, 150, 200, 189, 507, 510, 509, 517, 508, 511; 395/157, 164, 118, 155, 128, 131, 116, 115

[56] References Cited

U.S. PATENT DOCUMENTS

| | | | |
|---|---|---|---|
| 4,567,515 | 1/1986 | Schumacher | 345/200 |
| 4,642,790 | 2/1987 | Minshull et al. | 395/157 |
| 4,688,167 | 8/1987 | Agarwal | 395/157 |
| 4,718,008 | 1/1988 | Chang et al. . | |
| 4,730,249 | 3/1988 | O'Quin, II et al. . | |
| 4,761,737 | 8/1988 | Duvall et al. . | |
| 4,873,652 | 10/1989 | Pilat et al. | 395/157 |
| 4,920,483 | 4/1990 | Pogue et al. . | |
| 4,926,322 | 5/1990 | Stimac et al. . | |
| 5,091,720 | 2/1992 | Wood | 395/157 |
| 5,142,276 | 8/1992 | Moffat | 345/189 |

OTHER PUBLICATIONS

IBM Technical Disc. Bulletin vol. 31, No. 2, Jul. 1988 "Video Memory Paging Mechanism" pp. 459–463.

IBM Technical Disc. Bulletin vol. 30, No. 11, Apr. 1988 "Addressing Method To Support Video Memory Interleaving" pp. 79–84.

IBM Technical Disc. Bulletin vol. 24, No. 2, Jul. 1981, P.J. Kennedy "Digital Data Storage Using Video Disc" pp. 1170–1171.

IBM Technical Disc. Bulletin vol. 34, No. 7b, Dec. 1991, pp. 309–312 "Method of Providing Small Computer Systems With Multiple Input/Output Operations".

IBM Technical Disc. Bulletin vol. 35, No. 3, Aug. 1992 "Profiling Technique for Memory Refernces within Individual Pages on Paging–Based Virtual Memory Systems" pp. 320–325.

IBM Technical Disc. Bulletin vol. 34, No. 10b, Mar. 1992 pp. 426–429 "Software Recovery of Page Faults on Microprocessors with Integrated Memory Management Units".

INSPEC pp. 1–6.

*Primary Examiner*—Chanh Nguyen

*Attorney, Agent, or Firm*—Jerrrey S. LaBaw; Andrew J. Dillon

[57] ABSTRACT

A method and system for the simultaneous high resolution display of multiple virtual DOS applications within a data processing system. The data processing system preferably includes a processor, a memory coupled to the processor and a display device coupled to the memory and processor. Multiple programs operating within the data processing system under the control of an operating system are capable of outputting multibank high resolution graphic displays. Each time an application which is either operating as a background task or displayed within a graphics applications window attempts to write to the display device the display data is written to a logical video buffer which is designated within a portion of the memory within the data processing system. A bank management function is provided in association with the logical video buffer and permits multibank high resolution graphic displays to be simultaneously maintained for multiple virtual DOS applications. A transition of an application from background task to foreground task will result in the writing of the logical video buffer to the display device or, alternately, at least a portion of the logical video buffer may be written to a displayed window within the graphics applications program, providing for the simultaneous high resolution display of multiple applications within a data processing system.

4 Claims, 6 Drawing Sheets

SIMULTANEOUS HIGH RESOLUTION DISPLAY WITHIN MULTIPLE VIRTUAL DOS APPLICATIONS IN A DATA PROCESSING SYSTEM

BACKGROUND OF THE INVENTION

1. Technical Field

The present invention relates in general to an improved data processing system and in particular to an improved method and system for generating high resolution graphics in a data processing system. Still more particularly, the present invention relates to a method and system for providing a simultaneous high resolution display within multiple virtual DOS applications in a data processing system.

2. Description of the Related Art

Computer display systems have become increasingly complex in recent years. This is particularly true with respect to the so-called "personal" computer. Since its initial introduction the personal computer has gradually enhanced the video graphic capability of such systems to permit personal computers to meet more sophisticated demands in the display area.

Initially, personal computers often utilized Color Graphics Adapters or CGA capable of a resolution of 640×200 pixels and up to four colors. These adapters were quickly supplanted by so-called "Enhanced Graphics Adapters" (EGA) capable of a resolution of 640×350 pixels while displaying up to sixteen colors, out of a possible list of sixty-four colors.

In recognition of a demand for improved video graphic capability within personal computers International Business Machines Corporation introduced the PS/2 personal computer in 1987 which adopted a new graphic standard. This standard is the Video Graphics Array (VGA) which was capable of a resolution of 640×480 pixels, while displaying up to 256 colors simultaneously out of a color palette of over 250,000 colors. Unlike the previous Enhanced Graphics Adapter (EGA), the new standard is able to both read and write hardware registers and was quickly adopted as the industry standard, providing a substantial improvement in the video display art. Numerous manufacturers have provided so-called "video adapter" boards which were capable of reproducing the Video Graphics Array (VGA) mode within existing computers.

More recently, this Video Graphics Array (VGA) mode has been surpassed by the so-called "Super Video Graphics Array" (SVGA) mode is capable of providing a resolution of 1,024×768 pixels and 256 colors. Numerous manufacturers now provide video adapters capable of supporting this highly enhanced video mode. For example, the Tseng Laboratories ET4000; ATI Technologies AT128800; Headland Technology HT209; Trident Microsystems TVGA8900; Western Digital Imaging WD90C1 1; Cirrus Logic CL-GD5422; and, the IBM VGA256C.

In order to utilize one of these SVGA graphics adapters it is necessary to provide an appropriate device driver which is capable of determining and setting the necessary registers within the data processing system which are required to implement these resolutions. This is typically accomplished in the prior art by statically coding the necessary information into the device driver.

While SGVA graphics adapters have provided an increase in the possible resolution of displays within personal computers, the manipulation of the large amount of data necessary to provide such resolutions has not been possible in the simultaneous display of multiple virtual DOS applications within a data processing system. High resolution graphics displays require the utilization of multiple banks of data within video buffers and the execution of multiple virtual DOS applications within so-called "Virtual DOS Machines" (VDM) has therefore not been implemented. Medium resolution displays which do not incorporate multibank video buffers have been implemented; however, the utilization of SGVA graphic adapters has led to a desire on the part of computer users to implement these high resolution graphic displays within all executing applications within a data processing system.

Thus, it should be apparent that a need exists for a virtual device driver which is capable of supporting the simultaneous high resolution display of graphics within multiple virtual DOS applications in a data processing system.

SUMMARY OF THE INVENTION

It is therefore one object of the present invention to provide an improved data processing system.

It is another object of the present invention to provide an improved method and system for generating high resolution graphics in a data processing system.

It is yet another object of the present invention to provide an improved method and system providing a simultaneous high resolution display within multiple virtual DOS applications in a data processing system.

The foregoing objects are achieved as is now described. The simultaneous high resolution display of multiple virtual DOS applications is provided within a data processing system. The data processing system preferably includes a processor, a memory coupled to the processor and a display device coupled to the memory and processor. Multiple programs operating within the data processing system under the control of an operating system are capable of outputting multibank high resolution graphic displays. Each time an application which is either operating as a background task or displayed within a graphics applications window attempts to write to the display device the display data is written to a logical video buffer which is designated within a portion of the memory within the data processing system. A bank management function is provided in association with the logical video buffer and permits multibank high resolution graphic displays to be simultaneously maintained for multiple virtual DOS applications. A transition of an application from background task to foreground task will result in the writing of the logical video buffer to the display device or, alternately, at least a portion of the logical video buffer may be written to a displayed window within the graphics applications program, providing for the simultaneous high resolution display of multiple virtual DOS applications within a data processing system.

The above as well as additional objects, features, and advantages of the present invention will become apparent in the following detailed written description.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF PREFERRED EMBODIMENT

Figure 1:
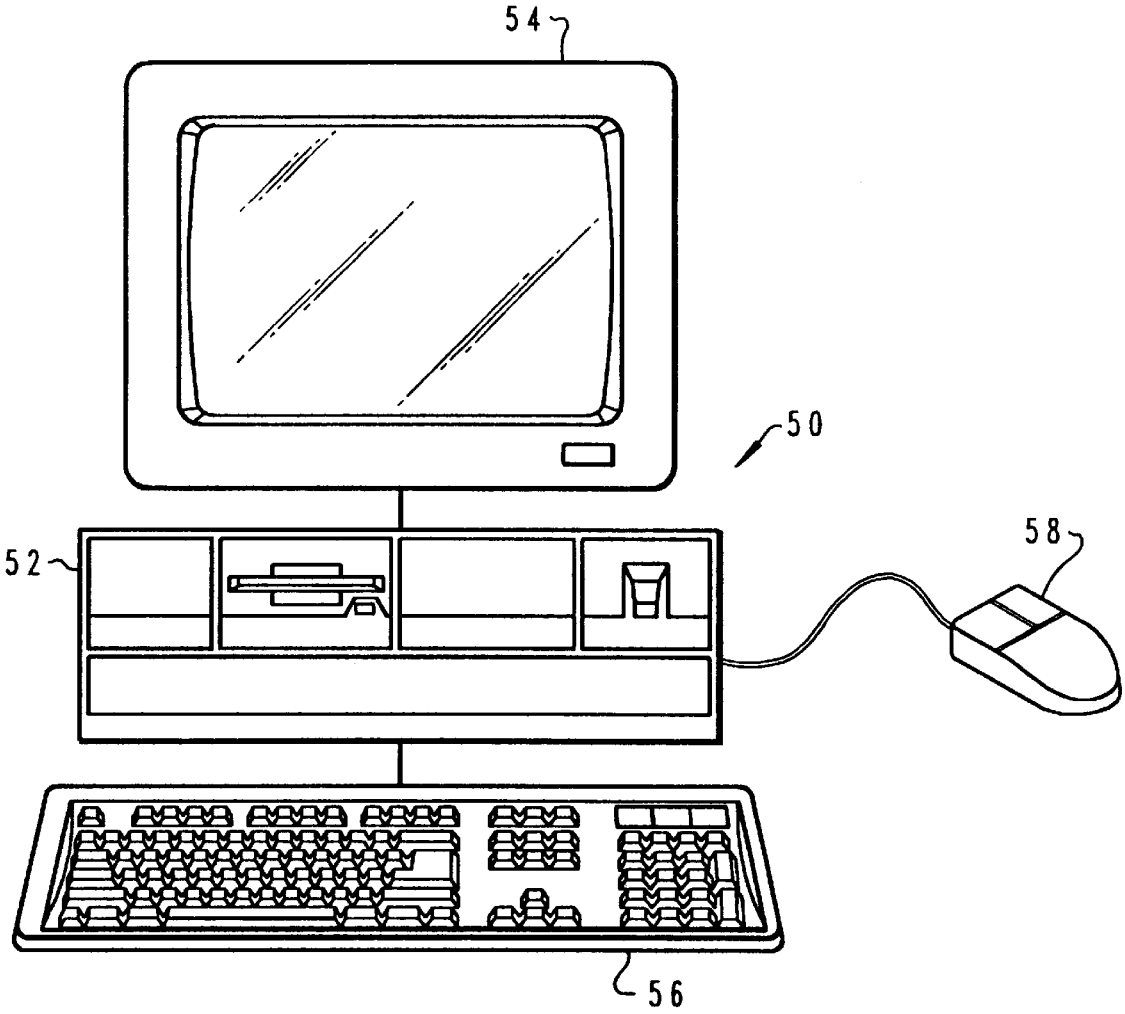
FIG. 1 is a pictorial representation of a data processing system which may be utilized to implement the method and system of the present invention.

With reference now to the figures and in particular with reference to FIG. 1, there is depicted a pictorial representation of a data processing system in which the present invention may be implemented in accordance with a preferred embodiment of the present invention. A personal computer 50 is depicted which includes a system unit 52, a video display terminal 54, a keyboard 56, and a mouse 58. Personal computer 50 may be implemented utilizing any suitable computer such as an IBM PS/2 computer, a product of International Business Machines Corporation, located in Armonk, N.Y. "PS/2 " is a registered trademark of International Business Machines Corporation, located in Armonk, N.Y. Although the depicted embodiment involves a personal computer, a preferred embodiment of the present invention may be implemented in other types of data processing systems, such as for example, intelligent work stations or mini-computers Referring now to FIG. 2, there is depicted a block diagram of selected components in personal computer 50 in which a preferred embodiment of the present invention may be implemented. System unit 52 preferably includes a system bus 60 for interconnecting and establishing communication between various components in system unit 52. Microprocessor 62 is connected to system bus 60 and also may have numeric coprocessor 64 connected to it. System bus 60 may be a Micro Channel system bus from International Business Machines Corporation. "Micro Channel" is a registered trademark of International Business Machines Corporation. Direct memory access (DMA) controller 66 is also connected to system bus 60 and allows various devices to appropriate cycles from microprocessor 62 during large I/O transfers.

Read Only Memory (ROM) 68 and Random Access Memory (RAM) 70 are also connected to system bus 60. ROM 68 contains the power-on self test (POST) and the Basic Input/Output System (BIOS) which control hardware operations, such as those involving disk drives and the keyboard. Read only memory (ROM) 68 is mapped into the microprocessor 62 address space in the range from 640K to 1 megabyte. CMOS RAM 72 is attached to system bus 60 and contains system configuration information.

Also connected to system bus 60 are memory controller 74, bus controller 76, and interrupt controller 78 which serve to aid in the control of data flow through system bus 60 between various peripherals, adapters, and devices. System unit 52 also contains various input/output (I/O) controllers such as: keyboard and mouse controller 80, video controller 82, parallel controller 84, serial controller 86, and diskette controller 88. Keyboard and mouse controller 80 provide a hardware interface for keyboard 90 and mouse 92. Video controller 82 provides a hardware interface for video display terminal 94. Parallel controller 84 provides a hardware interface for devices such as printer 96. Serial controller 86 provides a hardware interface for devices such as a modem 98. Diskette controller 88 provides a hardware interface for floppy disk unit 100. Expansion cards also may be added to system bus 60, such as disk controller 102, which provides a hardware interface for hard disk unit 104. Empty slots 106 are provided so that other peripherals, adapters, and devices may be added to system unit 52. For example, a Super Video Graphic Array (SVGA) controller card 108 is depicted as coupled to system bus 60.

Figure 2:
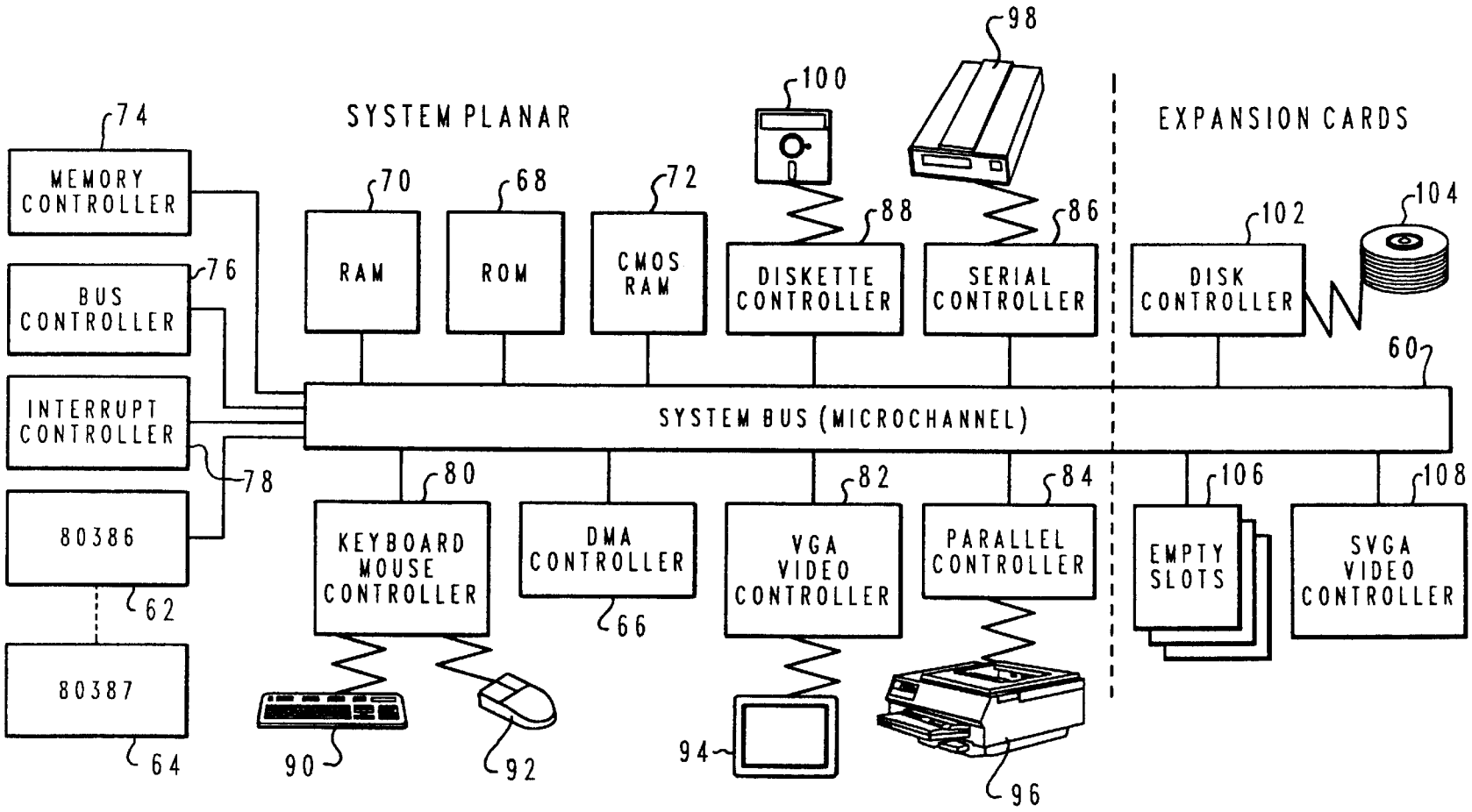
FIG. 2 is a high level block diagram of the data processing system of FIG. 1, which may be utilized to implement the method and system of the present invention.

Those skilled in the art will appreciate that the hardware depicted in FIG. 2 may vary for specific applications. For example, other peripheral devices such as: optical disk media, audio adapters, or chip programming devices such as a PAL or EPROM programming device, and the like also may be utilized in addition to or in place of the hardware already depicted.

Figure 3:
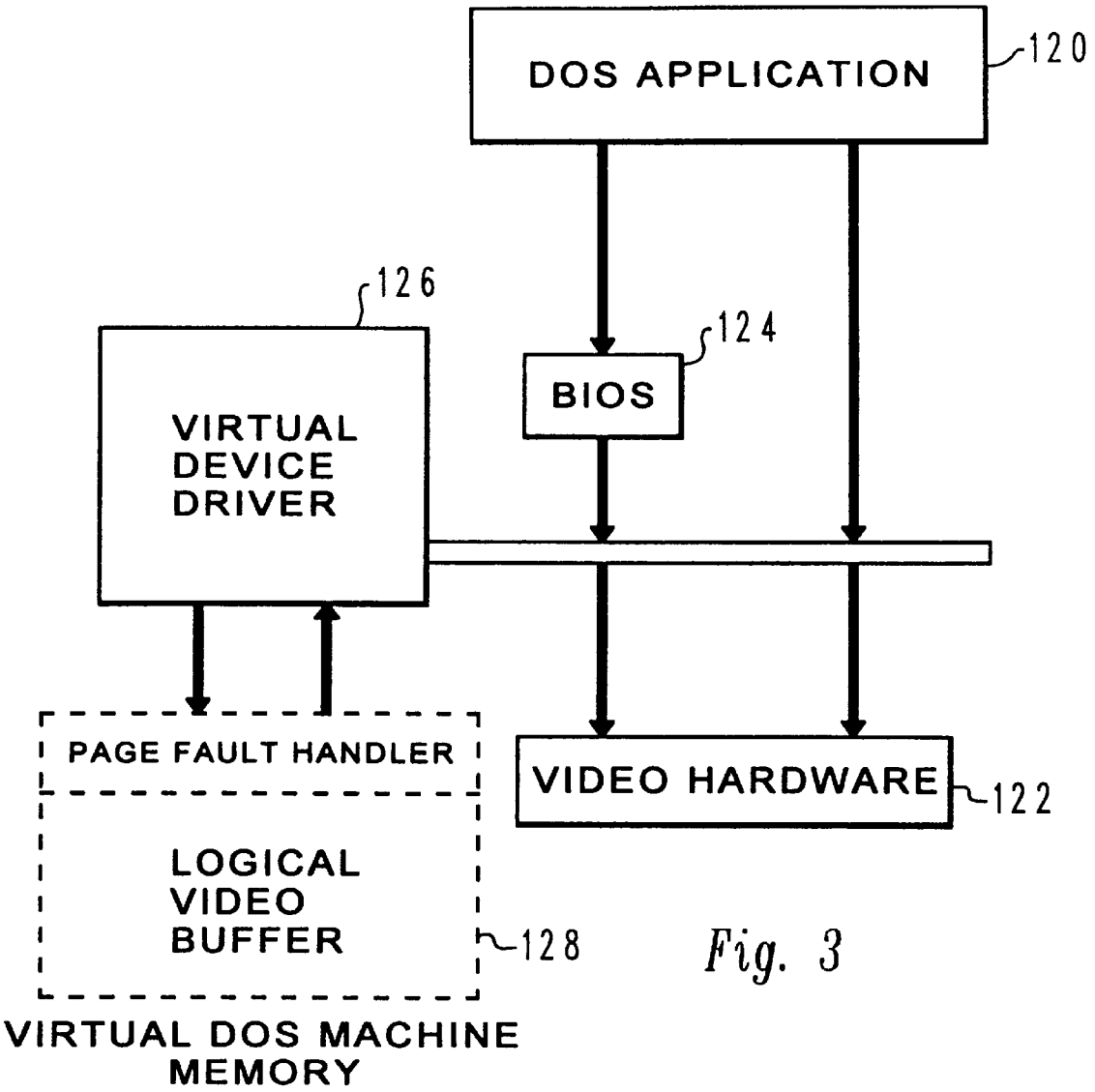
FIG. 3 is a high level block diagram of selected software modules which may be utilized to implement simultaneous high resolution graphics within multiple virtual DOS applications in accordance with the present invention.

With reference now to FIG. 3 there is dedicated a high level block diagram of selected software modules which may be utilized to implement simultaneous high resolution graphics within multiple virtual DOS applications in a data processing system in accordance with the method and system of the present invention. As illustrated, a DOS application 120 which is operated in "foreground," that is which occupies the entire display device, may be utilized to write display information directly to video hardware 122. In the event the display alteration does not require a change of mode or other substantial alteration, the display data is written directly to the physical video buffer which is located within video hardware 122. Those skilled in the art will appreciate that video hardware 122 preferably comprises an SGVA adapter, such as those described above in conjunction with an appropriate computer monitor. Alternately, in the event the video update to be written to video hardware 122 requires a mode alteration or other substantial changes the information is written to hardware 122 via basic input/output system (BIOS) 124.

Next, in accordance with an important feature of the present invention, in the event a DOS application 120 is operated in "background," that is, in a minimized or non-displayed manner, attempts to write video data to video hardware 122 will be intercepted by virtual device driver 126. Virtual device driver 126 utilizes a page fault handler which is established within virtual DOS machine memory 128 to detect attempts by a DOS application 120 to update the display in situations in which DOS application 120 is operated in background. This attempted alteration of the display may be determined as a result of an attempt by a DOS application 120 to write to the memory of video hardware 122, which is detected by the page fault handler established within virtual DOS machine memory, at reference numeral 128, or by detecting an attempted alteration of the bank select register. Those skilled in the art will appreciate that high resolution graphics display systems typically utilize multi-bank select systems to permit the video system to access larger amounts of video memory than would otherwise be possible.

In the event a DOS application 120 is detected as attempting to write video data to video hardware 122, while operated in a background or minimized state, the video data is written to a logical video buffer established within virtual DOS machine memory 128. A sufficient amount of memory within virtual DOS machine memory 128 must be set aside in order to permit the logical video buffer to store the amount of data necessary to implement a high resolutions graphics display. This is typically accomplished in linear modes by providing multiple so-called "banks" of sixty-four kilobytes of memory within virtual DOS machine memory 128. Thus, each "bank" of data within the attempted high resolutions graphics display is mapped to a section of sixty-four kilobytes of memory within the logical video buffer provided within virtual DOS machine memory 128. This updated image information will then be provided to the video display hardware following a transfer of that DOS application 120 to a "foreground" operation. Thus, by utilizing virtual device driver 126 and detecting an attempted alteration of a high resolution display by a DOS application 120, the bank and video data may be temporarily stored within logical video buffer 128 and thereafter utilized to update a high resolution graphics display for that DOS application 120, following the transfer of that DOS application 120 from a background to a foreground operation.

Figure 4:
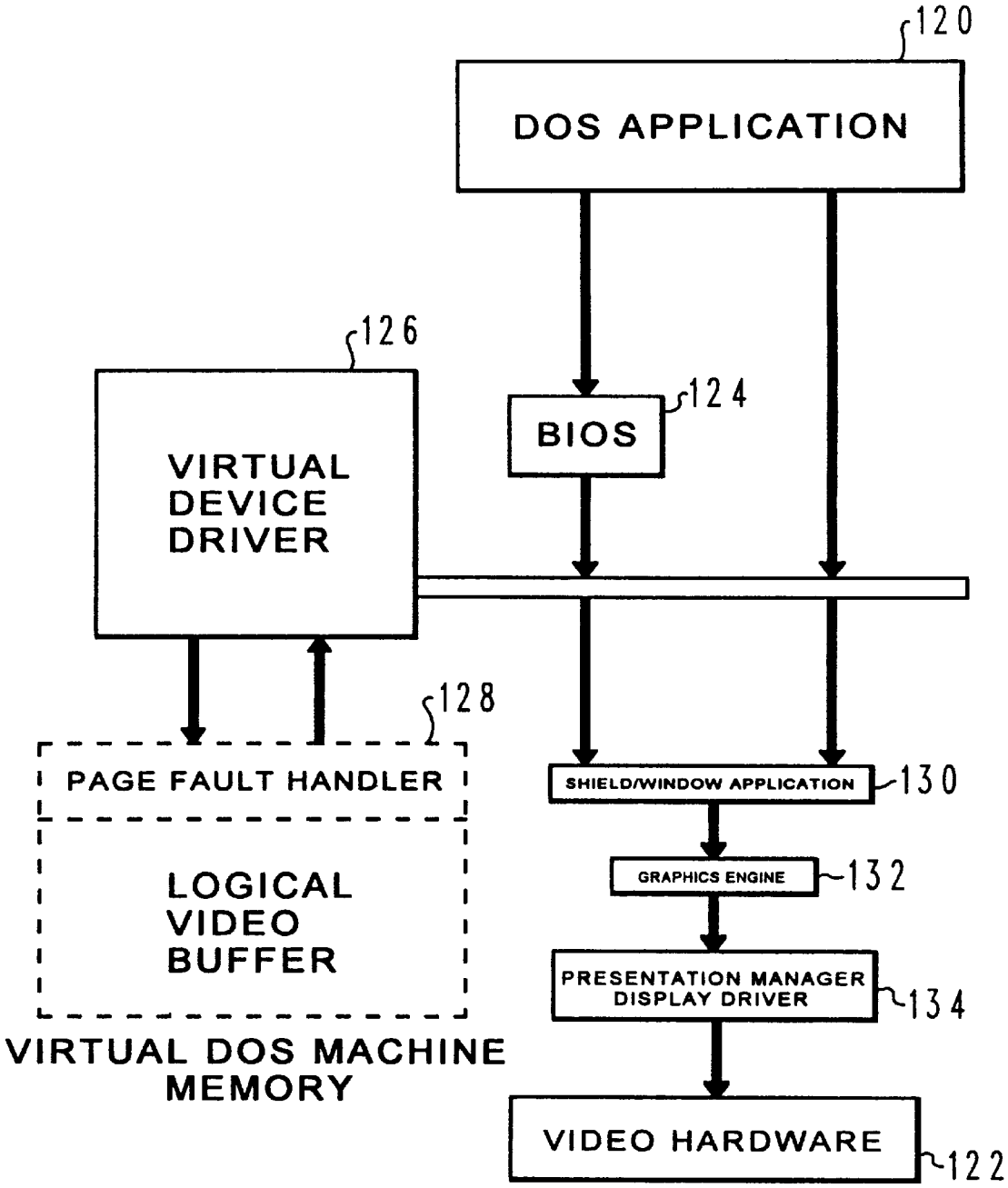
FIG. 4 is a high level block diagram of selected software modules which may be utilized to implement a windowed display of high resolution graphics within multiple virtual DOS applications in accordance with the method and system of the present invention.

Referring now to FIG. 4, there is depicted a high level block diagram of selected software modules which may be utilized to implement a windowed display of high resolution graphics within multiple virtual DOS applications, in accordance with the method and system of the present invention. As described above with respect to FIG. 3, a DOS application 120 may implement a high resolution graphics display by utilizing virtual device driver 126, in a manner described herein. An attempt to update the display by a DOS application 120, which is detected as a result of an attempt by a DOS application 120 to write to the memory of video hardware 122 will be detected by the page fault handler within virtual DOS machine memory 128, or by an attempted alteration of the bank select register. In such situations, the video data is mapped to a logical video buffer provided within virtual DOS machine memory 128 and thereafter may be written to video hardware 122 by coupling that data from virtual device driver 126 to a shield/window application 130. This may be implemented utilizing a well known shield/window application, such as Presentation Manager, provided by International Business Machines Corporation of Armonk, N.Y. Next, the output of shield/window application 130 is coupled through graphics engine 130 to an appropriate display driver for the graphics application to be utilized. Thus, as depicted within FIG. 4, the display driver for Presentation Manager may be utilized to couple to the content of a logical video buffer within virtual DOS machine memory to video hardware 122.

In the manner described herein, high resolution graphics display updates are detected by virtual device driver 126 and first written to a logical video buffer within virtual DOS machine memory 128. Thereafter, for a windowed display of a DOS application 120, the video data contained within the logical video buffer within virtual DOS machine memory 128 is written to the display device utilizing the display driver associated with a graphics application, such as Presentation Manager. By simulating the multi-bank video capability of an SGVA adapter within virtual DOS machine memory, high resolution graphics displays may be simultaneously provided for multiple applications within video hardware 122, utilizing the bank select management capability of the logical video buffer which is provided within virtual DOS machine memory 128.

Figure 5A:
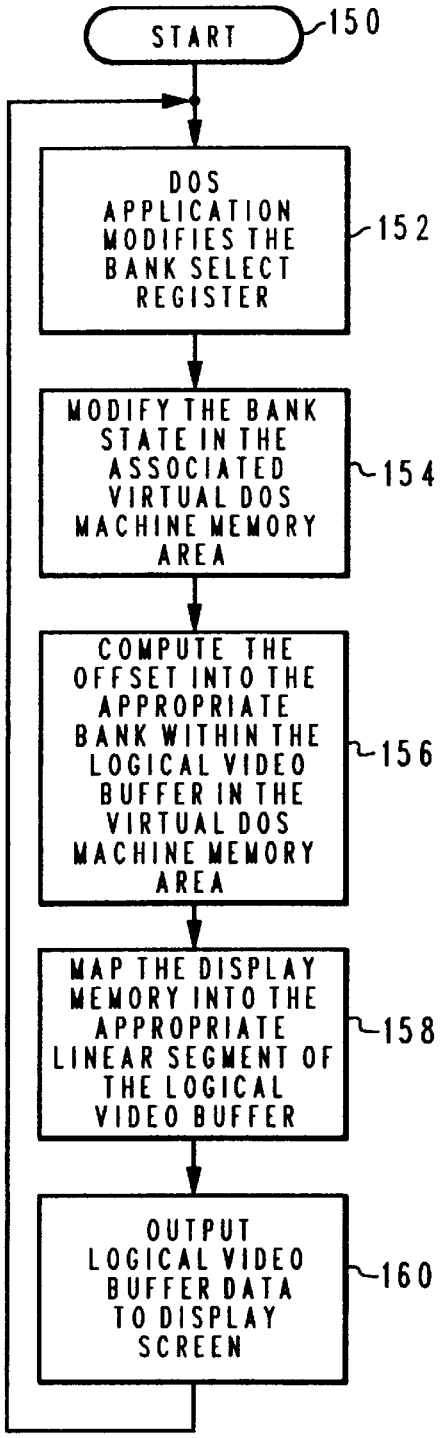
FIGS. 5*a* and 5*b* are a high level logic flowcharts illustrating a process for the display of simultaneous high resolution graphics within multiple virtual DOS applications in accordance with the method and system of the present invention.
Figure 5B:
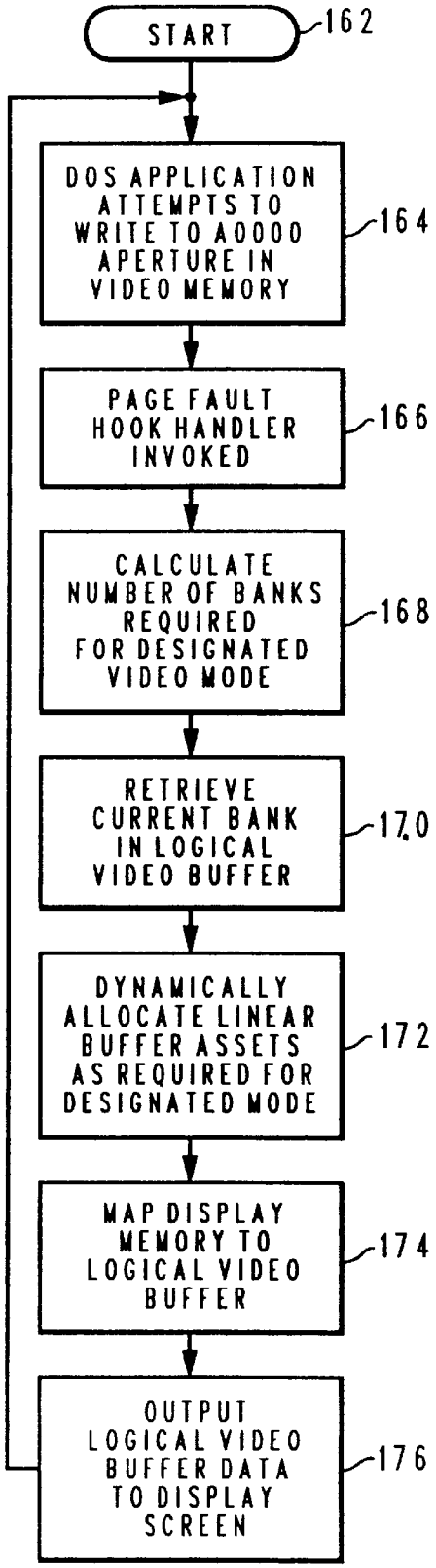

With reference now to FIGS. 5*a* and 5*b*, there are depicted high level logic flowcharts which illustrates a process for the display of simultaneous high resolution graphics within multiple virtual DOS applications, in accordance with the method and system of the present invention. As those skilled in the art will appreciate, the provision of a multibank high resolution graphic display requires that the application providing such display have the capability of manipulating a multibank video buffer. An attempted manipulation of a multibank video buffer may be detected by one of two techniques. As illustrated within FIG. 5*a*, an attempted manipulation of a multibank high resolution graphic display may be detected by a determination that the application has modified the bank select register, indicating that a designated bank within multiple banks of video display is to be modified. This process begins at block 150 and thereafter passes to block 152.

Block 152 illustrates a determination that a DOS application has modified the bank select register, indicating that one bank of video display data is to be modified. Next, the process passes to block 154. Block 154 illustrates the modifying of the bank state in the associated virtual DOS machine memory area which provides the logical video buffer (see FIGS. 3 and 4) for the associated DOS application.

Next, block 156 illustrates the computing of the offset into the appropriate bank within the logical video buffer in the virtual DOS machine memory area. The process then passes to block 158 which depicts the mapping of the display memory into the appropriate linear segment of the logical video buffer within the virtual DOS machine area (see FIGS. 3 and 4). Finally, block 160 illustrates the outputting of the logical video buffer data to the display screen. As described above, this may occur as a result of a transition of a DOS application from a background state to a foreground state, in which case the content of the logical video buffer will be utilized to refresh the display with the context of the application which is now designated as foreground. Alternately, in a situation in which the DOS application is displayed within a window in a graphics application, such as Presentation Manager, the logical video buffer data is output to the display screen via a shield/window application and a display driver associated with that graphics application.

Referring now to FIG. 5*b*, a logic flowchart is illustrated which depicts the display of simultaneous high resolution graphics within multiple virtual DOS applications in which an attempted output by the DOS application is detected by an attempt on the part of that DOS application to write to video memory. As above, this process begins at block 162 and thereafter passes to block 164. Block 164 illustrates a detection of an attempt on the part of the DOS application to write to the "A000" aperture within video memory. This action invokes the page fault hook handler, as illustrated at block 166. Next, as depicted at block 168 the number of banks of memory required for the designated video mode are determined. Those skilled in the art will appreciate that high resolution graphics displays require multiple banks of memory to be utilized and it is an important feature of the present invention that a logical video buffer is provided which includes multibank management capability.

Next, as depicted at block 170, the current bank within the logical video buffer within the virtual DOS machine memory area is retrieved. Block 172 then illustrates the dynamic allocation of linear buffer assets as required for the designated mode. Of course, if the display mode has not altered, the number of banks required has previously been set forth within the logical video buffer and need not be modified. Thereafter, block 174 illustrates the mapping of the display memory to the logical video buffer within the virtual DOS machine memory area. Finally, as described above, the logical video buffer data is output to the display screen either in response to a transition of the DOS application from a background state to the foreground state or, in the event the DOS application is displayed within a window within a graphics application, via the shield/window application and the appropriate display driver.

As set forth within FIGS. 5*a* and 5*b* those skilled in the art will appreciate that an attempt on the part of a DOS application to output a multibank high resolution graphics display may be detected by a modification of the bank select register or by an attempt to write to memory within the video device. In either event, the method and system of the present invention may be utilized to detect that occurrence and write the video data to a logical video buffer which is provided within the virtual DOS machine memory area of the data processing system. In this manner, a logical video buffer is provided which includes multibank management capabilities such that the simultaneous high resolution display of multiple virtual DOS applications may be provided within a data processing system.

Figure 6:
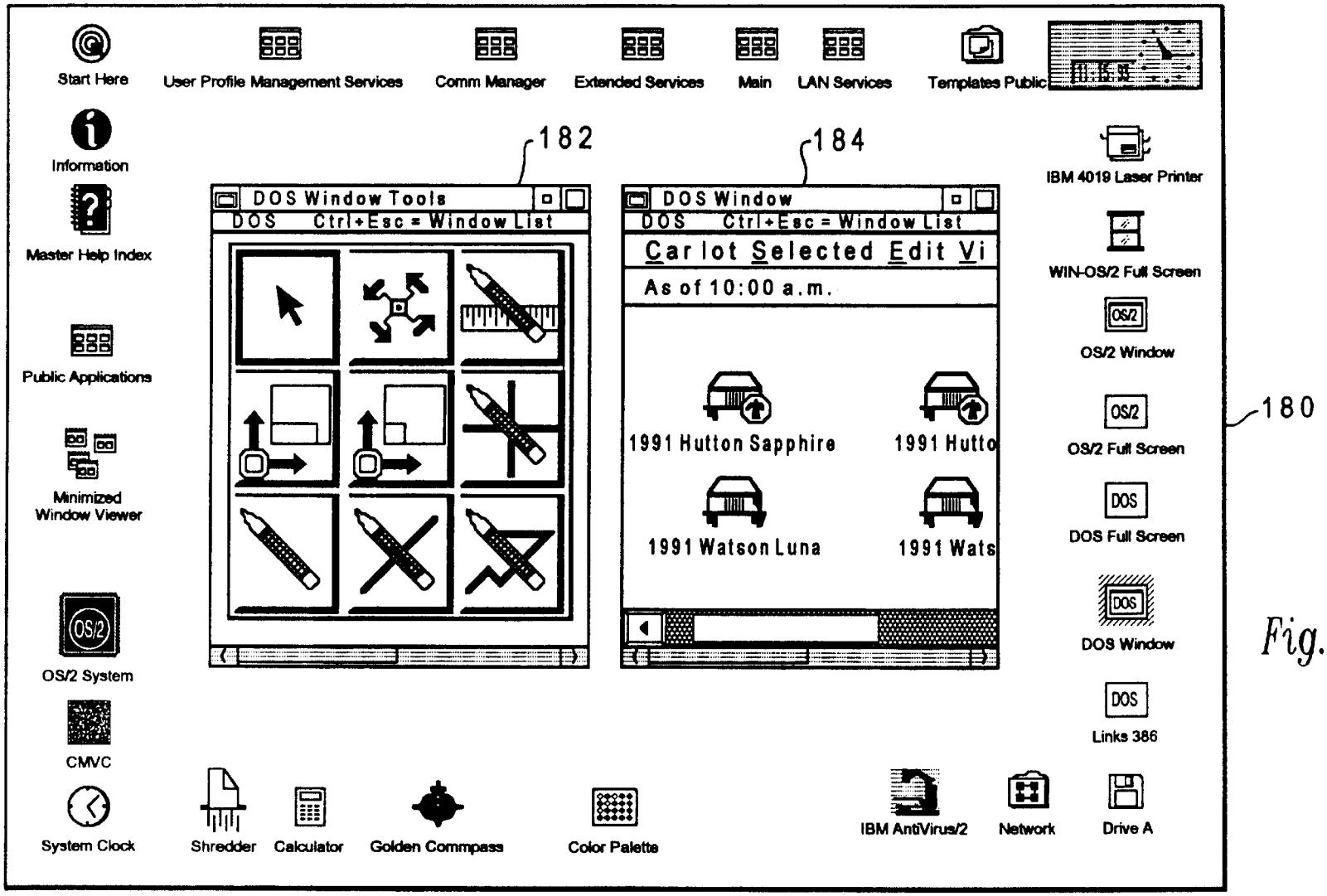
FIG. 6 is a pictorial representation of the simultaneous display of high resolution graphics within multiple windowed virtual DOS applications in accordance with the method and system of the present invention.

Finally, with reference to FIG. 6, there is depicted a pictorial representation of the simultaneous display of high resolution graphics within multiple windowed virtual DOS applications in accordance with the method and system of the present invention. As illustrated, a display screen 180 which may be displayed within data processing system 50 of FIG. 1 is depicted. Displayed within display screen 180 are windows 182 and 184. In accordance with the method and system of the present invention, attempted updates to the high resolution graphics display within each of these windows are written to a logical video buffer which has been established within virtual DOS machine memory 128. Updates to the display within each window are then accomplished, via the Presentation Manager application display driver such that simultaneous high resolution graphics display may be provided within multiple DOS applications which are provided within window displays in a data processing system in accordance with the method and system of the present invention.

In summary, the method and system of the present invention provides a multi-bank high resolution graphics display management system which permits multi-bank high resolution graphics display to be managed within a logical video buffer which is provided within a virtual DOS machine memory. In this manner, if sufficient system memory is available, multiple simultaneous high resolution graphics displays may be provided. This may be implemented in an operating system which provides an extra array dimension to the existing apPlane, anpgPlane and aapstate arrays which permit more virtual memory to be managed. As set forth below within Table 1, up to four banks, together with current structures, may be utilized to permit up to one megabyte of memory to be managed. It should be noted that by placing the new BANK index first the present structure is consistent with existing definitions when setting an index of zero, by virtue of the manner in which "C" stores arrays. In linear modes, banks, together with planes, may be utilized to provide up to sixteen pages of sixty-four kilobytes of memory each. This concept of planes then becomes deemphasized and the resultant combination may be utilized to track the entire memory range.

A further refinement of this technique set forth within Table 1 permits the more efficient management of video memory for applications which utilize enhanced video modes where video memory is organized as a contiguous linear address space. Access to such memory may be accomplished on a bank granular basis on sixty-four kilobyte sections. Virtual memory may then be managed in the same way by maintaining a bank state array (ABSTATE). A single pointer to a buffer representing physical memory is then kept (pLinearBuffer) and application accesses are then mapped to the appropriate "bank" within the buffer. This technique permits simpler virtualization, the efficient save and restore of physical video buffers and bit map copying.

During a device driver initialization process, a PMI file is read and global data access is updated with the appropriate data. Since the array subscript for BANKS is the first subscript in the array structure, it is appropriate for both VGA and SGVA systems. For VGA systems the BANK number will always be zero, but for SGVA systems the BANK number will vary with the capability of the specific SGVA adapter. SGVA adapters with high resolution graphics capability may be accommodate by this additional bank management layer. In this manner, the system may be extended to accommodate SGVA adapters with any amount of video memory by simply increasing the maximum bank limit, with no resultant impact on VGA systems.

TABLE 1

```
// bank/plane/page management variables
pbyte   apPlane[MAX_BANKS] [MAX_PLANES];
// pointer(s) to virtual memory buffers
ULONG   anpgPlane[MAX_BANKS] [MAX_PLANES];
// size(s) for each of the above buffers
PSTATE aapstate[MAX_BANKS]
[MAX_PAGESPERPLANE] [MAX_PLANES];
// page state array
// bank management variables
PBYTE   pLinearBuffer;
// virtual buffer for linear modes
BSTATE abstate[MAX_BANKS*MAX_PLANES];
// bank state array
```

Table 2, depicted below, illustrates how a virtual device driver can be utilized to manage the transfer of up to one megabyte from virtual or physical address space in accordance with the method and system of the present invention.

TABLE 2

```
BOOL PRIVENTRY vvTransferBuffer(register HVDM hvdm,
                                INT iBank, BOOL fVRAM)
{
register INT iPage;
register INT iPlane;
/***True copy state unknown at this point ***/
pVDMData(hvdm)->mstateCopy = MEMORY_NONE;
/***For every plane ***/
for (iPlane=0; iplane < MAX_PLANES; iplane++)   {
    /*** For every page in the current plane ***/
    for (iPage=0; iPage < MAX__PAGESPERPLANE; iPage ++)
        if (!vvTransferPage (hvdm, iPage, iPlane, iBank, fVRAM))
}
return TRUE;
}
```

While the invention has been particularly shown and described with reference to a preferred embodiment, it will be understood by those skilled in the art that various changes in form and detail may be made therein without departing from the spirit and scope of the invention.

We claim:

1. A data processing system comprising:

a processor;

a memory coupled to said processor;

a display device coupled to said memory and said processor a video adapter coupled to said display device and said processor;

an operating system stored within said memory and executable by said processor;

a first software application stored in said memory and executable by said processor under control of said operating system, said first software application providing a multibank high resolution graphic display output which includes both bank and video data;

a second software application stored in said memory and simultaneously executable with said first software application by said processor under control of said operating system, said second software application providing a multibank high resolution graphic display output;

a physical video buffer including a bank management function within said video adapter for receiving a multibank high resolution graphic display output from one of said software applications which has been designated by said operating system as a foreground task;

a logical video buffer designated within a portion of said memory and including a bank management function for receiving a multibank high resolution graphic display output from one of said programs which has been designated by said operating system as a background task; and means integrated within said operating system for simultaneously updating both said physical video buffer and said logical video buffer simultaneously.

2. The data processing system according to claim 1, further including means for writing said physical video buffer to said display device.

3. The data processing system according to claim 2, further including means for writing said logical physical video buffer to said video buffer in response to a transition of one of said software applications from a background task to a foreground task.

4. A method for simultaneous high resolution display within multiple applications in a data processing system having a processor, a memory coupled to said processor, a display device coupled to said memory and said processor and a display adapter coupled to said display device and said processor which includes a physical video buffer said method comprising the steps of:

providing a logical video buffer within said memory, said logical video buffer including a bank management function for receiving a multibank high resolution graphic display output which includes both bank and video data from one of a plurality of applications within said data processing system;

detecting an attempt by said one of said plurality of applications within said data processing system to output a multibank high resolution graphic display to said physical video buffer within said display adapter;

writing said multibank high resolution graphic display output from said one of said plurality of applications within said data processing system to said logical video buffer; and subsequently writing said logical video buffer to said physical video buffer in response to a transition of said one of said plurality of applications from a background task to a foreground task.

* * * * *

UNITED STATES PATENT AND TRADEMARK OFFICE

CERTIFICATE OF CORRECTION

PATENT NO. : 6,091,430
DATED : July 18, 2000
INVENTOR(S) : Bodin et al.

It is certified that error appears in the above-identified patent and that said Letters Patent is hereby corrected as shown below:

Column 1,
Line 55, please delete "WD90C1 1" and insert -- WD90C11 --.

Signed and Sealed this

Twenty-sixth Day of November, 2002

*Attest:*

*Attesting Officer*

JAMES E. ROGAN
*Director of the United States Patent and Trademark Office*